US009506201B2

(12) United States Patent
Furman et al.

(10) Patent No.: US 9,506,201 B2
(45) **Date of Patent: *Nov. 29, 2016**

(54) DEBONDER AND SOFTENER COMPOSITIONS

(71) Applicant: Nalco Company, Naperville, IL (US)

(72) Inventors: Gary S. Furman, St. Charles, IL (US); Gillian Frette, Voorburg (NL); Frank Koenig, Gelsenkirchen (DE); Tobias Maurer, Velbert (DE)

(73) Assignee: Nalco Company, Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/975,113

(22) Filed: Aug. 23, 2013

(65) Prior Publication Data

US 2013/0340963 A1 Dec. 26, 2013

Related U.S. Application Data

(63) Continuation of application No. 13/185,011, filed on Jul. 18, 2011, now Pat. No. 8,518,214.

(51) Int. Cl.

| | |
|---|---|
| ***D21H 11/00*** | (2006.01) |
| ***D21H 21/14*** | (2006.01) |
| ***D21H 17/33*** | (2006.01) |
| ***D21H 17/34*** | (2006.01) |
| ***D21H 17/46*** | (2006.01) |
| ***D21H 17/52*** | (2006.01) |
| ***D21H 21/22*** | (2006.01) |
| ***D21H 27/00*** | (2006.01) |

(52) U.S. Cl.

CPC ..... *D21H 21/14* (2013.01); *D21H 17/33* (2013.01); *D21H 17/34* (2013.01); *D21H 17/46* (2013.01); *D21H 17/52* (2013.01); *D21H 21/22* (2013.01); *D21H 27/002* (2013.01)

(58) Field of Classification Search

USPC ..... 162/164.3, 111, 112, 158

See application file for complete search history.

(56) References Cited

U.S. PATENT DOCUMENTS

| | | | | |
|---|---|---|---|---|
| 5,698,076 | A * | 12/1997 | Phan et al. | 162/111 |
| 8,518,214 | B2 * | 8/2013 | Furman et al. | 162/164.3 |
| 2003/0056917 | A1 | 3/2003 | Jimenez | |

FOREIGN PATENT DOCUMENTS

| | | | |
|---|---|---|---|
| EP | 1013825 | B2 | 6/2009 |
| KR | 100499918 | B1 | 11/2005 |
| WO | 0063493 | A1 | 10/2000 |
| WO | 2006071175 | A2 | 7/2006 |
| WO | 2007058609 | A2 | 5/2007 |

* cited by examiner

*Primary Examiner* — Mark Halpern
(74) *Attorney, Agent, or Firm* — Leydig, Voit & Mayer, Ltd.

(57) ABSTRACT

The invention provides methods and compositions for softening paper. An inventive composition and method of its use softens paper products (like tissue paper) by de-bonding its cellulose fibers and by improving the smoothness of the resulting paper. The invention forms a surfactant-polymer complex that attaches de-bonding non-ionic surfactants to cellulose fibers that would otherwise not be retained by the cellulose fibers. This complex prevents the fibers from bonding with each other and makes the paper product smoother. Best of all, the composition is environmentally superior and is a non-toxic.

15 Claims, No Drawings

DEBONDER AND SOFTENER COMPOSITIONS

CROSS-REFERENCE TO RELATED APPLICATIONS

This application is a continuation of co-pending U.S. patent application Ser. No. 13/185,011 filed on Jul. 18, 2011 and which will issue as U.S. Pat. No. 8,518,214.

STATEMENT REGARDING FEDERALLY SPONSORED RESEARCH OR DEVELOPMENT

Not Applicable.

BACKGROUND OF THE INVENTION

This invention applies to paper webs or sheets, and more specifically to tissue or paper tissue webs, that are commonly used in paper towels, napkins, facial and toilet tissues. The important characteristics for such papers (simply referred to as 'tissue papers' from this point on) are bulk, softness, absorbency, stretch and strength. There is an ongoing work to improve each of these characteristics without seriously affecting the others. Methods for making conventional wet pressed (CWP) and through-air-dried (TAD) tissue papers are well known in the art. Both types of tissue papers are formed by draining a cellulosic fiber suspension through a forming fabric to create the paper web. The cellulosic fiber suspension is deposited onto the forming fabric by means of a headbox which uniformly deposits the suspension. Depending on machine type, there can be some initial vacuum or centrifugal dewatering of the web. For CWP tissue papers, the web is further dewatered at the pressure roll, where the sheet is pressed between the pressure roil and the Yankee dryer to a typical consistency of 40-45%. Final drying is accomplished by the steam heated Yankee dryer in combination with hot air impingement hoods. For TAD tissue papers the web is further dried by the through-air dryer(s) which force hot air through the web to obtain a typical consistency of 60-85%. Again, final drying is accomplished by the steam heated Yankee dryer in combination with hot air impingement hoods.

Conventional fluff pulp and methods for making such pulp are well known in the art. Important properties include absorbency, burst strength and specific shredding energy. Such pulp is typically made by forming a thick web or sheet on a Fourdrinier wire and subsequently pressing and drying the paper sheet into bales or rolls haying a consistency of 8-10%. The dry bales or rolls are subsequently defiberized using a hammermill or a pin defiberizer to form fluff. Typical products made from fluff are diapers, feminine hygiene products and incontinence products. Fluff can also be used to produce various air laid absorbent pads and paper products.

Softness is a tactile sensation perceived by the consumer holding a particular product, rubbing it across the skin or crumpling it within the hand. Softness comprises two components, hulk softness and surface softness. Bulk softness relates to how easily the paper product flexes, crumples, or otherwise yields to even delicate counter-forces. Surface softness relates to how smooth or with how much lubricity the paper product can be slid against another surface. Both of these forms of softness can be achieved by mechanical means. For example, the sheet can be calendered to flatten the crests formed when creping the sheet and improve surface softness. Through-air-drying of the sheet improves bulk softness. However, mechanical approaches by themselves are often insufficient to meet consumer softness demands.

One way to make the paper softer is to add a softening compound to the cellulosic suspension. The softening compound interferes with the natural fiber-to-fiber bonding that occurs during sheet formation in papermaking processes. This reduction of bonding leads to a softer, or less harsh, sheet of paper. WO 98/07927 describes the production of soft absorbent paper products using a softener. The softener comprises a quaternary ammonium surfactant, a non-ionic surfactant as well as strength additives. The softening agent is added to the cellulosic suspension before the paper web is formed.

A softening compound can also be applied to a dry or wet paper web e.g. by means of spraying. If the paper web is dry, the softening compound can also be printed on the paper. U.S. Pat. No. 5,389,204 describes a process for making soft tissue paper with a functional polysiloxane softener. The softener comprises a functional-polysiloxane, an emulsifier surfactant and surfactants which are noncationic. The softener is transferred to the dry paper web through a heated transfer surface. The softener is then pressed on the dry paper web. WO 97/30217 describes a composition used as a lotion to increase the softness of absorbent paper. The composition comprises an emollient which is preferably a fatty alcohol or a waxy ester. The composition also comprises a quaternary ammonium surfactant as well as one or more non-ionic or amphoteric emulsifiers.

Most softening compounds, either added to the cellulosic suspension or applied directly to the paper web, contain quaternary ammonium surfactants. Since producers and consumers are experiencing a growing environmental concern, quaternary ammonium surfactants are not always accepted. The quaternary ammonium surfactants are generally toxic to aquatic organisms and are generally considered dangerous for the environment. The quaternary ammonium surfactants can be irritating to eyes and skin, and in some cases the irritation to eyes can be severe. Thus there is clear utility in compositions that debond and soften paper products that have less deleterious effects on the environment and have improved health profiles.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

To satisfy the long-felt but unsolved needs identified above, at least one embodiment of the invention is directed towards a method of softening a paper product. The method comprises: adding an effective amount of a composition to a mass containing cellulose fibers. The composition comprises at least one non-ionic surfactant and at least one cationic polyelectrolyte polymer coagulant. The polyelectrolyte polymer coagulant is characterized in having an overall cationic character and which can form stable emulsions with the nonionic surfactant. The composition effectively de-bonds the cellulose fibers.

The polyelectrolyte polymer coagulant may have anionic regions within the overall cationic polymer. The at least one cationic polymer may be a poly(DADMAC). The at least one polymer may be an epi-DMA polymer. The cationic polymer may have a low or high molecular weight. The composition may create a complex that prevents bonding interactions between the cellulose fibers. The composition may improve surface softness. The paper product may be tissue paper. The mass may be paper slurry. The composition may be an aqueous solution added to paper slurry. The composition may be sprayed onto the surface of the mass. The composition may be non-toxic.

Additional features and advantages are described herein, and will be apparent from, the following Detailed Description.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"Coagulant" means a composition of matter which is cationically charged and includes one or more organic based coagulants, or one or more inorganic based coagulants, and/or any combination and/or blend thereof, which destabilizes and initially aggregates colloidal and/or finely divided material suspended in a liquid.

"Epichlorohydrin-Dimethylamine Polymer" means a copolymer of epichlorohydrin and dimethylamine also referred to as epi-DMA polymer. The epi-DMA polymer may be crosslinked, for example with ammonia. The epi-DMA has a weight average molecular weight between 1000 and 1,000,000; preferably between 10,000 and 800,000; and most preferably between 100,000 and 600,000 Da.

"High molecular weight polymer" means a polymer having an average molecular weight greater than 1,000,000 Daltons.

"Inorganic Based Coagulant" means a coagulant which is predominantly inorganic including but not limited to alum, partially neutralized aluminum salts such as polyaluminum chlorides, ferric salts such as chloride and sulfate, and polymers thereof.

"Low molecular weight polymer" means a polymer with an average molecular weight of less than 250,000 Daltons.

"Medium molecular weight polymer" means a polymer having an average molecular weight in the range from 250,000 to 1,000,000 Daltons.

"Nonionic Surfactant" means a non-charged surfactant which includes but is not limited to alkanolamides, alkoxylated alcohols, amine oxides, ethoxylated amines, alkoxylated amides, EO-PO-block copolymers, alkoxylated fatty alcohols, alkoxylated fatty acid esters, alkylarylalkoxylates, sorbitan derivatives, polyglyceryl fatty acid esters, alkyl (poly)glucosides, fluorocarbon-based surfactants, and any combination thereof. Nonionic Surfactants typically have an HLB range between 3 and 18 with a preferred range between 4 and 14.

"Organic Based Coagulant" means a coagulant which is predominantly organic and which includes but is not limited to epichlorohydrin/dimethylamine polymers (epi-DMA) including crosslinked versions, ethylene dichloride/ammonia polymers, ethyleneimine polymers (PEI), diallyldimethylaminonium chloride polymers (p-DADMAC), acrylamidopropyltrimethyl ammonium chloride polymers, polyamidoamines, amidoamine-epichlorohydrin polymers, copolymers of DADMAC and acrylamide, copolymers of DADMAC and acrylic acid (polyampholytes—as long as net charge is cationic), polyvinylamines. hydrolyzed N-vinylformamide polymers, polyamines, modified PEI (polyamidoamines grafted with PEI), and 2-cyanoguanidine based polymers including combinations with formaldehyde, urea and melamine.

"Poly(DADMAC)" means a homopolymer of diallylmethylammonium chloride (DADMAC). The monomer DADMAC is formed by reacting two equivalents of allyl chloride with dimethylamine. The pDADMAC has a weight average molecular weight between 1000 and 3,000,000; preferably between 25,000 and 2,000,000; and most preferably between 100,000 and 1,500,000 Da. A low molecular weight p-DADMAC has a weight average molecular weight less than 250,000 Da. A medium molecular weight p-DADMAC has a weight average molecular weight in the range from 250,000 to 1,000,000 Da. A high molecular weight pDADMAC has a weight average molecular weight greater than 1,000,000 Da.

"Polyelectrolyte" means a polymer whose repeating units bear an electrolyte group.

"Surfactant" means a composition of matter characterized in being a surface active agent having an amphiphilic structure which includes a hydrophilic head group and a hydrophobic tail group and which lowers the surface tension of a liquid, the interfacial tension between two liquids, or that between a liquid and a solid.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc) this definition shall control how the term is to be defined in the claims.

The present invention relates to methods and compositions that soften paper products and in particular tissue products. In at least one embodiment a composition is provided which comprises a combination of nonionic surfactants and cationic polymers formulated to provide an easy to use, stable, liquid product. This composition is both effective at softening paper products and has a superior environmental profile when compared with prior art cationic surfactants.

In at least one embodiment the composition comprises a blend of nonionic surfactants and cationic polymers, which does not need to be labeled with an R-phase (risk phrase) according to the European Union's (EU) MSDS system as being very toxic, toxic, harmful, or cause long-term adverse effects in the aquatic environment. This includes both singular risk phrases such as R50, R51, R52, and R53, as well as the multiple risk phrases such as R50/53, R51/53, and R52/53, In at least one embodiment the composition need not be labeled with an "N" code and therefore can be packaged and sold in the EU without a dangerous for the environment, dead tree, or dead fish logo on it.

In at least one embodiment the nonionic surfactant is any surfactant which is nonionic, and which is sufficiently hydrophobic so as to effectively de-bond the cellulose fibers used in making tissue paper or other paper products. In at least one embodiment the cationic polymer is a polyelectrolyte, which may have anionic regions but which has an overall cationic character and which can form stable emulsions with nonionic surfactants.

In at least one embodiment the cationic polymer is a poly(DADMAC) polymer of high molecular weight (such as 8108+ by Nalco Company, Naperville Ill.), of intermediate molecular weight (such as 74316 by Nalco Company), of low molecular weight (such as 74696 by Nalco Company), and any combination thereof.

EXAMPLES

The foregoing may be better understood by reference to the following examples, which are presented for purposes of illustration and are not intended to limit the scope of the invention. In particular the examples demonstrate representative examples of principles innate to the invention and these principles are not strictly limited to the specific condition recited in these examples. As a result it should be understood that the invention encompasses various changes and modifications to the examples described herein and such changes and modifications can be made without departing from the spirit and scope of the invention and without diminishing its intended advantages. It is therefore intended that such changes and modifications be covered by the appended claims.

Example 1

In this example the preparation of softener formulations utilizing several cationic coagulants and a non-ionic surfactant is demonstrated. For softener Formulation 1, eight parts of an oleic acid polyglycol ester (Rewopol® EO 70) (available from Evonik Industries) was added to 82 parts of distilled water while stirring. Next, 10 parts of p-DADMAC (Nalco 8108 PLUS) was added to this dilute mixture with additional stirring. Formulation 1 was a stable macro-emulsion having a milky to slightly yellow appearance and a viscosity of 100 mPa·s at 25° C. Similarly for Formulation 2, eight parts of Rewopol® EO 70 was added to 82 parts of distilled water while stirring. Ten parts of p-DADMAC (Nalco 74316) was added to the dilute mixture with additional stirring. Formulation 2 was stable and had a milky to slightly yellowish macro-emulsion appearance with a viscosity of 100 mPa·s at 25° C. Finally for Formulation 3, eight parts of Rewopol® EO 70 was added to 89.5 parts of distilled water while stirring. Next 2.5 parts of p-DADMAC (Nalco 74696) was added to the dilute mixture with additional stirring. Formulation 3 was stable and had a milky to slightly yellowish macro-emulsion appearance with a viscosity of 100 mPa·s at 25° C.

Example 2

In this example the preparation of a second example formulation is demonstrated. An epi-DMA coagulant (Nalco 7607 Plus) was added to an equal quantity of distilled water while stirring. Next, 33.8 parts of this blend was added to 66.2 parts of an oleic acid polyglycol ester (Rewopol® EO 90) (available from Evonik Industries). This produced a stable product dispersion called Softener Formulation 4 that had a yellowish turbid appearance and a viscosity of approximately 1500 mPa·s at 25° C.

Example 3

Softener Formulations 1, 2 and 3 prepared in Example 1 were evaluated in handsheet studies to determine the amount of tensile strength loss they produced compared to industry standards Arosurf® PA 777V and Arosurf® PA 842V (available from Evonik Industries). Handsheets were produced using a Rapid-Kothen former according to ISO Procedure 5269-2. The furnish was a 50/50 blend of hardwood and softwood dry lap pulp. The softener formulations were added to the furnish at doses of 1, 3 and 5 kg/MT of dry fiber. The diameter of the sheets was 21 cm and the corresponding sheet weights were approximately 1.25 grams resulting in a basis weight of approximately 36.1 g/m2. The sheets were conditioned under standard recommendations for temperature and humidity (TAPPI Method T 402) and evaluated for tensile strength following TAPPI Method T 220.

The results are provided in Table I. The industry standard products Arosurf® PA 777V and 842V provide good debonding of the handsheets as determined by the measured loss in tensile index. A loss in tensile index correlates to an increase in bulk softness of the sheets. Similarly, the Product Formulations 1, 2, and 3 of Example 1 all showed a loss in tensile index compared to the Blank sheet used as a control. The industry standard products Arosurf® PA777V and 842V have R-phrase labeling of R50/53 and danger symbol showing a dead tree and fish. The Product Formulations 1, 2, and 3 would not have the R50/53 phrase or the danger symbol.

TABLE I

Conditions and tensile index values for Example 3.

| Condition | Dose | Average Tensile Index (Nm/g) | Loss in Tensile (%) |
|---|---|---|---|
| Blank | 0 | 17.3 | — |
| PA 777V | 1 | 12.7 | 26.6 |
| PA 777V | 3 | 8.1 | 53.2 |
| PA 777V | 5 | 6.7 | 61.3 |
| PA 842V | 1 | 12.7 | 26.6 |
| PA 842V | 3 | 9.1 | 47.4 |
| PA 842V | 5 | 8.3 | 52.0 |
| Formula 1 | 1 | 9.6 | 44.5 |
| Formula 1 | 3 | 14.5 | 16.2 |
| Formula 1 | 5 | 10.7 | 38.2 |
| Formula 2 | 1 | 14.2 | 17.9 |
| Formula 2 | 3 | 12.7 | 26.6 |
| Formula 2 | 5 | 11.5 | 33.5 |
| Formula 3 | 1 | 16.5 | 4.6 |
| Formula 3 | 3 | 9.8 | 43.4 |

Example 4

Softener Formulations 1, 2 and 3 from Example 1 were tested again in a second handsheet comparison to industry standards Arosurf® PA 777 and 842. Additional control experiments were also conducted to evaluate the effects of the individual components of the formulation, Rewopol EO 70 is an oleic acid polyglycol ester available from Evonik Industries. Nalco 8108 Plus is a high molecular weight p-DADMAC product available from Nalco Company. Handsheets were produced using a Messmer Model M 153 former according to TAPPI Method T205. The furnish was a 70/30 blend of hardwood and softwood dry lap pulp. The softener formulations were added to the furnish at doses of 1, 3 and 5 kg/MT of dry fiber. The diameter of the sheets was 15.9 cm and the corresponding sheet weights were approximately 1.0 gram resulting in a basis weight of approximately 60 g/m2. The sheets were conditioned under standard recommendations for temperature and humidity (TAPPI Method T 402) and evaluated for tensile strength following TAPPI Method T 220.

Tensile results are tabulated in Table II and again show that the industry standard products, Arosurf® PA 777V and 842V provided good debonding of the sheets. Oppositely, the nonionic surfactant, Rewopol E0 70, and the cationic coagulant, 8108 Plus, when dosed by themselves, provided minimal or no debonding of the sheets. However, when the individual nonionic surfactant and cationic coagulant components were combined together as in Softener Formulations 1, 2 and 3 then significant tensile index reductions occurred, thus demonstrating the utility of present invention.

TABLE II

Conditions and tensile index values for Example 4.

| Condition | Dose | Average Tensile Index (Nm/g) | Loss in Tensile (%) |
|---|---|---|---|
| Blank | 0 | 18.3 | — |
| PA 777V | 1 | 15.9 | 12.9 |
| PA 777V | 3 | 8.3 | 54.6 |
| PA 777V | 5 | 7.4 | 59.7 |
| PA 842V | 1 | 14.0 | 23.4 |
| PA 842V | 3 | 10.5 | 42.5 |
| PA 842V | 5 | 7.1 | 61.5 |
| EO 70 | 1 | 18.6 | −1.5 |
| EO 70 | 3 | 17.5 | 4.4 |
| EO 70 | 5 | 17.5 | 4.6 |
| 8108 Plus | 1 | 16.5 | 9.9 |
| 8108 Plus | 3 | 16.4 | 10.4 |
| 8108 Plus | 5 | 16.4 | 10.7 |
| Formula 1 | 1 | 16.4 | 10.6 |
| Formula 1 | 3 | 11.0 | 40.1 |
| Formula 1 | 5 | 9.7 | 46.8 |
| Formula 2 | 1 | 15.1 | 17.3 |
| Formula 2 | 3 | 9.6 | 47.4 |
| Formula 2 | 5 | 11.8 | 35.6 |
| Formula 3 | 1 | 16.5 | 9.6 |
| Formula 3 | 3 | 12.5 | 31.6 |
| Formula 3 | 5 | 6.2 | 66.2 |

Example 5

In this example Softener Formulation 4 was compared to industry standard products Arosurf® PA 777 and Rewoquat® WE 15 DPG (available from Evonik Industries) in handsheet debonding experiments. Handsheets were produced using a Messmer Model M 153 former according to TAPPI Method T205. The furnish was a 50/50 blend of hardwood and softwood dry lap pulp. The softener formulations were added to the furnish at doses of 1, 3 and 5 kg/MT of dry fiber. The diameter of the sheets was 15.9 cm and the corresponding sheet weights were approximately 1.9 gram resulting in a basis weight of approximately 100 g/m2. The sheets were conditioned under standard recommendations for temperature and humidity (TAPPI Method T 402) and evaluated for tensile strength following TAPPI Method T 220.

Tensile results are tabulated in Table III and again show that the industry standard products, Arosurf® PA 777V and Rewoquat® WE 15 DPG provided good debonding of the sheets. Formulation 4 provided equally good debonding, evidenced by the similar loss of tensile strength in the sheets compared to the industry standard products.

TABLE III

Conditions and tensile index values for Example 5.

| Condition | Dose | Average Tensile Index (Nm/g) | Loss in Tensile (%) |
|---|---|---|---|
| Blank | 0 | 18.9 | — |
| PA 777V | 1 | 15.8 | 16.4 |
| PA 777V | 3 | 9.4 | 50.3 |
| PA 777V | 5 | 8.0 | 57.9 |
| Rewoquat WE 15 DPG | 1 | 16.4 | 13.4 |
| Rewoquat WE 15 DPG | 3 | 11.1 | 41.3 |
| Rewoquat WE 15 DPG | 5 | 8.0 | 57.7 |
| Formula 4 | 1 | 17.1 | 9.8 |
| Formula 4 | 3 | 10.4 | 45.1 |
| Formula 4 | 5 | 7.7 | 59.1 |

The data demonstrates that nonionic surfactants and cationic polymers when used alone have little effect on tensile strength. Their combination however demonstrates a marked and completely unexpected synergistic effect, which decreases tensile strength of paper products to levels comparable with more toxic compositions currently commonly used in the tissue making industry.

Without being limited in theory and the scope afforded in construing the claims, it is believed that the synergistic composition better attaches de-bonding materials than the prior art can. Cellulose fibers are anionic so they naturally repel anionic compositions, which would otherwise effectively debond them. In the invention, the cationic polymers and surfactants create a complex, which is attracted to the fiber surface and thereby prevents fiber-fiber bonding interactions.

This invention provides unexpectedly good results by using a simple two component formulation and does not contain an anionic component, compared to other prior art de-bonding compositions having four components and containing at least one anionic component. For example WO 2006/071175 and WO 2007/058609 both disclose compositions containing at least four components and containing at least one anionic component selected from anionic surfactants and anionic microparticles. In at least one embodiment the composition excludes having any one anionic component. In at least one embodiment the composition excludes a four (or more) component formulation of the composition.

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments mentioned herein, described herein and/or incorporated herein. In addition the invention encompasses any possible combination that also specifically excludes any one or some of the various embodiments mentioned herein, described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of softening a paper product, the method comprising:

adding a composition to a mass containing cellulose fibers, the composition comprising a combination of at least one non-ionic surfactant and at least one cationic polyelectrolyte polymer coagulant, the cationic polyelectrolyte polymer coagulant selected from ethylene dichloride/ammonia polymers, ethyleneimine polymers, acrylamidopropyltrimethyl ammonium chloride polymers, polyamidoamines, amidoamine-epichlorohydrin polymers, copolymers of DADMAC and acrylamide, copolymers of DADMAC and acrylic acid, polyampholytes, polyvinylamines, hydrolyzed N-vinylformamide polymers, polyamines, polyamidoamines grafted with PEI, 2-cyanoguanidine based polymers, a poly(DADMAC), and an epi-DMA, the polyelectrolyte polymer coagulant having a cationic character.

2. The method of claim 1 in which the composition further comprises at least one cationic polymer which is an epi-DMA.

3. The method of claim 1 in which the composition further comprises at least one cationic polymer which is a poly (DADMAC).

4. The method of claim 1, wherein the strength of the paper decreases in the presence of the composition.

5. The method of claim 1 in which the paper product is tissue paper.

6. The method of claim 1 in which the mass is paper slurry.

7. The method of claim 1 in which composition is an aqueous solution added to paper slurry.

8. The method of claim 1 in which composition is sprayed onto the surface of the mass.

9. The method of claim 1 in which composition is non-toxic.

10. The method of claim 1, wherein the cationic polyelectrolyte polymer coagulant has anionic regions.

11. The method of claim 1, wherein the cationic polyelectrolyte polymer coagulant has a molecular weight of greater than 4500 Daltons.

12. The method of claim 1 in which the cationic polymer cationic polyelectrolyte polymer coagulant is an inorganic based coagulant.

13. The method of claim 1 in which the stable emulsion is characterized as having an energy barrier imparting a repulsive force between surfactant-coagulant droplets of at least 20 kT.

14. A sheet of paper made out of a mass comprising cellulose fibers to which the method of claim 1 was performed.

15. A sheet of paper comprising a mass containing cellulose fibers, wherein the cellulose fibers have been treated during a papermaking process with a composition comprising a combination of at least one non-ionic surfactant and at least one cationic polyelectrolyte polymer coagulant, the polyelectrolyte polymer coagulant having a cationic character, and the at least one cationic polyelectrolyte polymer selected from epi-DMA, poly(DADMAC), and combinations thereof.

* * * * *